United States Patent [19]

Wright

[11] Patent Number: 4,768,417

[45] Date of Patent: Sep. 6, 1988

[54] DETONATOR NET WEAPON

[76] Inventor: James E. Wright, 18 Rosedale Dr., Stafford, Va. 22554

[21] Appl. No.: 106,657

[22] Filed: Oct. 13, 1987

[51] Int. Cl.[4] ..... F42B 22/24

[52] U.S. Cl. ..... 89/1.11; 102/406; 102/411

[58] Field of Search ..... 89/1.11; 102/401, 405, 102/406, 409–412

[56] References Cited

U.S. PATENT DOCUMENTS

| | | | |
|---|---|---|---|
| 1,173,463 | 2/1916 | Reno | 102/412 |
| 1,271,864 | 7/1918 | Digney | 102/409 |
| 1,278,602 | 9/1918 | D'Amico | 102/412 |
| 1,309,391 | 7/1919 | Adkins | 102/409 |

FOREIGN PATENT DOCUMENTS

| | | | |
|---|---|---|---|
| 529623 | 11/1940 | United Kingdom | 89/1.11 |

*Primary Examiner*—Charles T. Jordan

*Attorney, Agent, or Firm*—Martin P. Hoffman; Mitchell B. Wasson; Charles W. Fallow

[57] ABSTRACT

A detonator net weapon for use primarily in anti-submarine warfare. The weapon comprises spaced, interwoven alternating lengths of nylon rope and detonator cord, and the detonator cord is ignited by conventional battery-powered target contact detectors. Floats at the top of the net control the buoyancy of the net and thus regulate its rate of descent through the water. The net weapon is stored in a compact container, and may be deployed from an airplane or from a ship into the path of a submarine, hydrofoil, torpedo, missile, or the like. The detonator cord, upon ignition, will explode with sufficient force to damage any object in contact thereof. The detonator net weapon is versatile and may be used against special types of surface ships, torpedoes, etc., and may, with minor revisions, be used in land warfare against tanks and infantry. In addition, the net weapon may be configured for use against anti-armor and/or sea-skimmer missiles.

10 Claims, 2 Drawing Sheets

DETONATOR NET WEAPON

FIELD OF THE INVENTION

The invention relates generally to weapons used to defend against attacks by submarines or by surface craft, and more particularly pertains to offensive weapons that may be readily deployed in such a fashion as to inflict sufficient damage to submarines or surface craft to cause mission abort.

BACKGROUND OF THE INVENTION

High strength, metallic nets have been deployed defensively against submarine attacks for several years. The nets may be paid out from a vessel, as shown in U.S. Pat. No. 2,383,095, granted to D. A. Wallace, or may be stretched across the depth and width of a narrow body of water, and anchored to the floor of the body of water, as shown in U.S. Pat. No. 2,170,481, granted to J. J. Morrison et al. Diverse other defensive nets are disclosed in the prior art—see, for example, U.S. Pat. No. 2,388,459, granted to C. S. Allen, Jr.

Known metallic nets, however, are costly to manufacture, and have proven difficult to store on board a sea-going vessel because of their significant weight and bulk. Also, when known metallic nets are paid overboard from a platform on the vessel, the vessel is subjected to considerable drag and must operate at reduced speeds. The time required to deploy these nets is measured in hours or days. Conventional nets are essentially static in operation, and are either fixed to the ocean floor or to the floor of a smaller body of water, or dragged slowly through the water adjacent a large vessel, such as a battleship. In either case, known nets are defensive in character, and have proven ineffective against the new generations of deep ranging, mobile, high speed, nuclear powered submarines as well as against maneuverable surface vessels. Furthermore, known nets are readily detected by radar and sonar such that evasive actions can be undertaken to defeat such nets.

SUMMARY OF THE INVENTION

Thus, with the deficiencies of known defensive anti-submarine nets and similar devices clearly in mind, the present invention contemplates a detonator net weapon that is both offensive and defensive in character and is capable of rapid deployment from an airplane, a surface ship, a mortar or a gun. The detonator net weapon assumes the form of a net comprising alternating, spaced, and interwoven strands of nylon and detonator cord so that the net, when floating in the water, will escape detection by sonar, and, when extending above the water, will escape detection by radar. The detonator cord will be ignited by battery powered target contact detector mechanisms located at the edges of the net in both a water deployed configuration and a land deployed configuration. Nylon imparts strength to the net, while the detonator cord provides the explosive force for the net weapon.

Furthermore, the present invention envisions a relatively inexpensive net weapon that can be purchased in quantity, and discharged in salvos, if necessary, for maximum effectiveness in damaging and/or destroying submarines, torpedoes, missiles, surface ships such as air cushion, surface effect or hydrofoils, tanks and infantry. The detonator net weapon may utilize floats so that its rate of descent through the water may be tailored to meet diverse operational conditions. For land use, the floats may be replaced with compressible pylons to hold the upper edge of the weapon above the ground.

Additionally, the detonator net weapon can be folded into a compact package that can be stored in a pod beneath the wing of an anti-submarine or strike aircraft, or can be stored aboard a surface ship for deployment therefrom. Smaller packages can be produced for use by guns and mortars.

Whereas the unique detonator net was intially envisioned as an offensive weapon capable of defending against attack by submarines or by surface craft, the detonator net is equally adept at defending surface ships from torpedo attacks, when the surface ship detects a torpedo homing in upon the ship. With but minimal modification, the detonator net may be used as a tactical weapon to defend against attacks, on land, by infantry. Similarly, the detonator net may be used with equal facility as a tactical weapon to defend against attacks by tanks and armored vehicles of all types. With a modification to the target contact detector, the detonator net may be used against anti-armor or sea-skimmer missiles.

Numerous other military objectives that can be achieved by the present invention will occur to the skilled artisan when the appended drawings are construed in harmony with the ensuing specification.

DESCRIPTION OF THE PREFERRED EMBODIMENT

Figure 1:
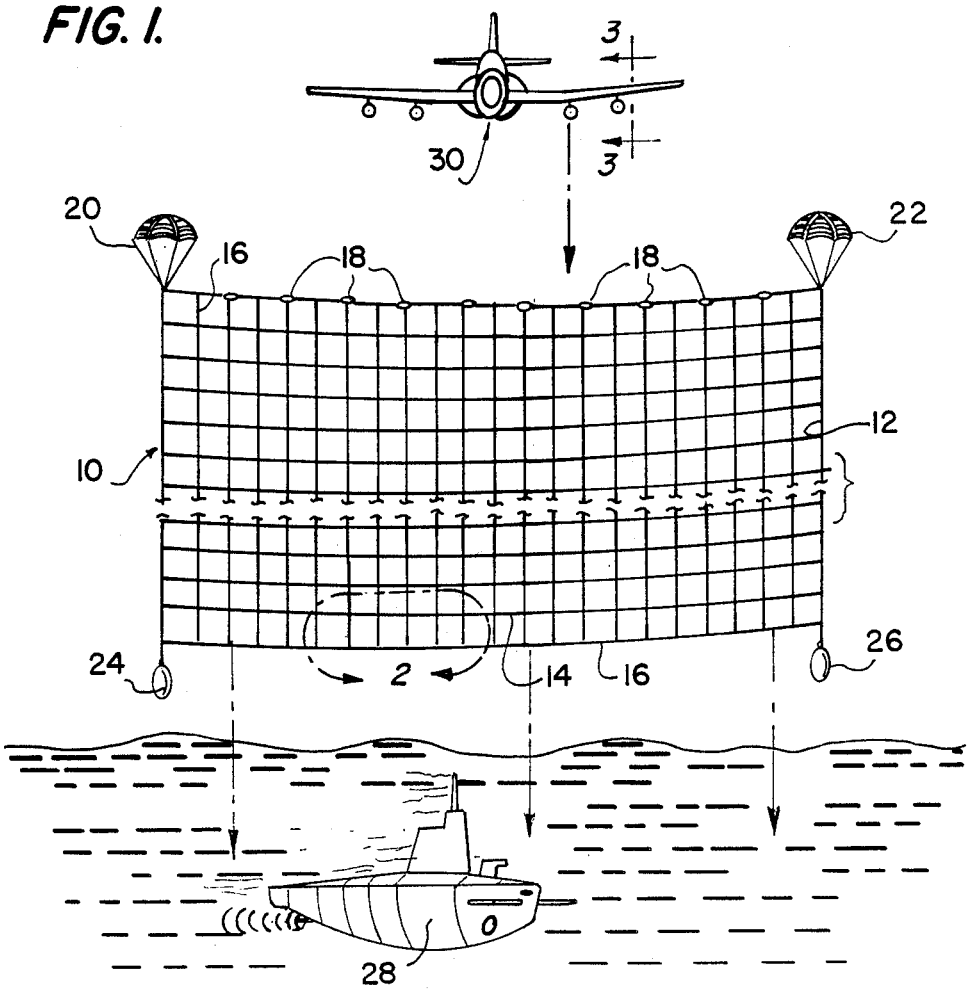
FIG. 1 is a schematic representation of a detonator net weapon constructed in accordance with the principles of this invention being deployed from a plane against a submarine.
Figure 2:
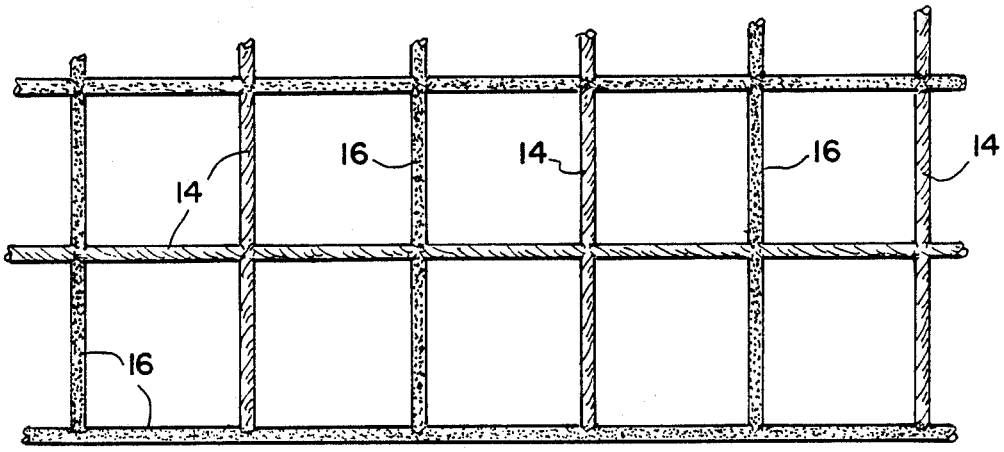
FIG. 2 is a front elevation view, on an enlarged scale, of a fragment of the detonator net, such view being within the area indicated by reference numeral "2" and directional arrows in FIG. 1.
Figure 3:
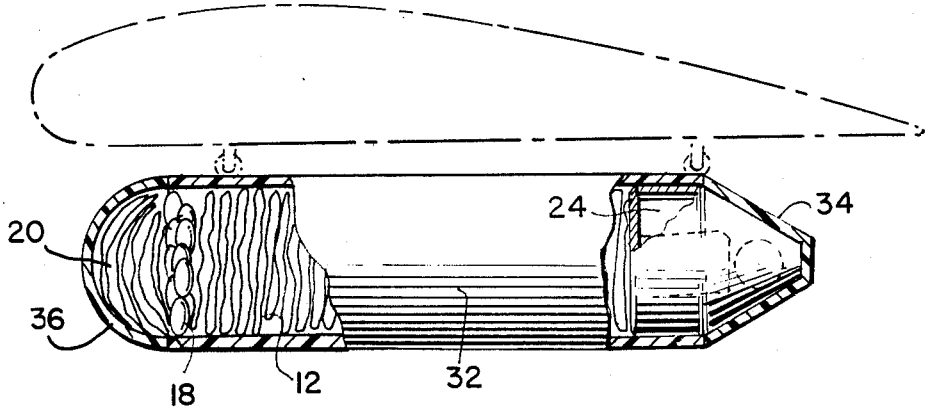
FIG. 3 is a vertical cross-sectional view, on an enlarged scale, of the detonator net weapon stored in a pod beneath the wing of a plane, such view being taken along line 3—3 in FIG. 1 and the direction indicated.

Referring now to the drawings, FIGS. 1–3 depict the preferred embodiment of a detonator net weapon constructed in accordance with the principles of this invention. The detonator net weapon is identified generally by reference numeral 10, and comprises a unique net 12 comprised of spaced, interwoven, and alternating lengths of nylon rope 14 and detonator cord 16 that extend in both the horizontal and vertical directions. In the enlarged view of FIG. 2, the lengths of nylon rope 14 are shown only as lengths of plastic, while the lengths of detonator cord 16 are accented by stippling. The lengths of nylon and the lengths of detonator cord are approximately equal in diameter, but the nylon rope is far stronger than the detonator cord and provides a supporting lattice for the detonator cord. Plastics other than nylon may be used for rope 14, provided that such plastics have strength and buoyancy characteristics equivalent to nylon.

Net 12 may be 500 meters in length, and 200 meters in height, in one illustrative application, so that the strength requirements of the nylon, or other plastic, are readily apparent. The detonator cord is an extrusion of plastic explosive which will burn at over 20,000 feet per second. Currently, the U.S. Navy uses three separate chemical formulations for detonator cord and does not produce any cord which is larger than ¼" in diameter. The selection of the type of explosive will have to be in accordance with the insensitive munitions requirement of the Department of Defense. The diameter of the detonator cord will be determined by the minimum explosive force required to cause damage to the enemy target.

Net weapon 10 further comprises a plurality of floats 18 that are spaced along the upper edge of the net 12. The number, and location, and shape of the floats is selected in relationship to the desired buoyancy characteristic of the net weapon. For example, if the net weapon is to be deployed with a slightly positive buoyancy so that the weapon, when deployed, will float just above the surface of the water for maximum effectiveness against surface vessels, several large pylon type floats will be used. Conversely, if the net weapon is intended for use against a submarine lurking well below the surface of the water, only a few floats may be used so that the net will sink rapidly into the path of the submarine.

Air stabilizers 20, 22 are secured to the opposite, upper corners of the net 12 to unfurl same. The stabilizers retard the descent of the net through the air toward the water, and provide ample time for the net to be unfurled and properly positioned for entry into the water. Control packages 24, 26 are secured to the opposite, lower corners of the net 12 to deploy same in cooperation with the air stabilizers 20, 22, as suggested by the directional arrows visible in FIG. 1.

A submarine 28 is "located" beneath the surface of the water, and the detonator net weapon 10 is intended to intersect the path of movement of the submarine and to damage such vessel. The net weapon is dropped into the water from a fixed wing aircraft 30, although, conceivably, the net weapon could also be deployed from a helicopter, as well.

FIG. 3 shows the manner in which the detonator net weapon 10 may be stored in a pod 32 fixed to the underside of a wing of aircraft 30, the wing being shown in dotted outline. Pod 32 has a hollow cylindrical body, with end caps 34, 36 secured to opposite ends of the body. Several pods are affixed to the aircrafts, and each pod contains an individual detonator net weapon, for such weapons are capable of being stored in a compact manner. The weight of each detonator net weapon may be approximately 2500 pounds.

Each pod 32 contains, in snug, space-saving fashion, the furled air stabilizers 20, 22, the floats 18, the detonator net 12, and the control packages 24, 26. Each control package contains initiators for igniting the detonator cord 16, a target contact detection device for detecting contact between the detonator net weapon and the target, and a salt-water battery, or comparable power source, for driving the initiators. Weights (not shown) may also be inserted into the control packages to insure that the descent of the detonator net weapon through the air and/or water takes place in the proper manner. The weights will function in concert with the air stabilizers to unfurl and orient the weapon 10, and may act to counteract floats 18 when the net weapon is deployed in the water. The net weapon is discharged from each pod 32 in a conventional manner.

Figure 4:
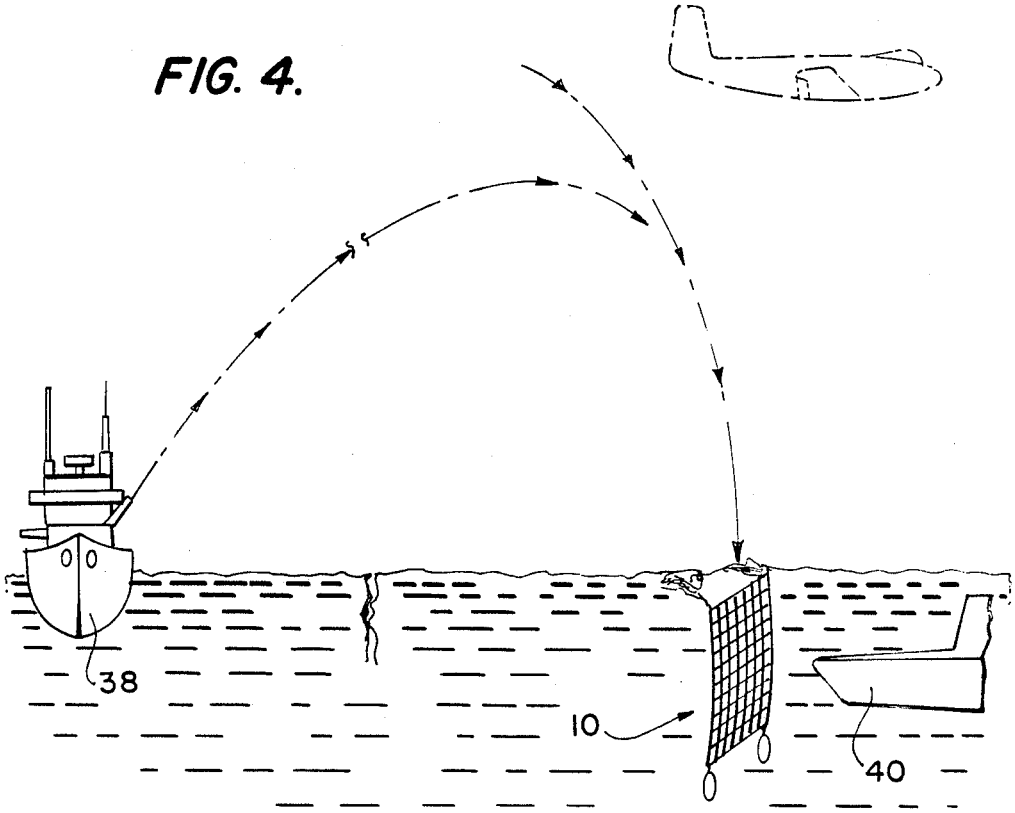
FIG. 4 is another schematic representation of the detonator net weapon, such view suggesting that such weapon may be deployed either from a vessel, or from a plane, into the path of a submarine.

FIG. 4 schematically illustrates that the detonator net weapon 10 can easily be launched from a surface vessel 38 into the path of a submarine 40. An airplane, such as a submarine patrol plane, shown in dotted lines, can drop additional detonator net weapons and blanket the suspected path of movement of the submarine. The relative low cost of the detonator net weapon lends itself to combined sea and air operations, and reduces the need to fire costly anti-submarine torpedoes. The detonator net weapon, if not ignited, will gradually sink to the bottom of the ocean floor and will not impede, or endanger, normal maritime traffic through the area in which an enemy submarine was detected and attacked.

Various refinements, modifications, and alterations, may be suggested by the skilled artisan versed in the arts to which this invention relates. For example, to abort the mission of tanks, the size of the detonator cord may be enlarged to provide sufficient explosive force to disable a track. This modification may be coupled with a modification to the target contact detection device and relocation of the device to other than the bottom of the net. To abort sea-skimmer missiles, a 50′×50′ net weapon may be launched by 5″ gun to provide an intermediate line of defence. Also, ballistic spreader mechanisms may be used in lieu of air stabilizers 20, 22.

Furthermore, while the preferred shape of the net is rectangular as shown in FIGS. 1–4, the net may be circular in configuration, particuarly where the net is to be deployed against anti-armor, or sea-skimmer, missiles. The particular polygonal shape selected for the net is thus broadly related to the nature of the weapon against which it is to be deployed.

Consequently, the appended claims should be broadly construed, and should not be limited to their literal terms.

I claims:

1. A detonator net weapon comprising:

(a) a net comprising spaced, interwoven, alternating lengths of plastic rope and detonator cord that define a polygonal body including an edge, (b) said plastic rope imparting strength to the net, (c) control packages secured to the edge of said net, and (d) said control packages including means to ignite said detonator cord so that said cord will explode with significant force.

2. A detonator net weapon as defined in claim 1 wherein said control packages include initiators for supplying thermal energy to said detonator cord, a target contact detection device, and a self-contained battery for powering said initiators.

3. A detonator net weapon as defined in claim 1 wherein said polygonal body is rectangular in shape with an upper edge and a lower edge.

4. A detonator net weapon as defined in claim 3 wherein the lower edge of the net is defined by a length of detonator cord that is connected between control packages situated at the opposite corners of the lower edge of said net.

5. A detonator net weapon as defined in claim 3 wherein floats are disposed along the upper edge of said net, said floats controlling the buoyancy of said net when deployed in a body of water.

6. A detonator net weapon as defined in claim 3 wherein air stabilizers are secured to the upper edge of said net, said stabilizers assisting in and providing adequate time for the weapon to be deployed before entering a body of water.

7. A detonator net weapon as defined in claim 1 wherein said detonator net can be folded into a compact package for storage in a pod affixed to an airplane.

8. A detonator net weapon as defined in claim 1 wherein said plastic rope is made of nylon, and the lengths of plastic rope and detonator cord alternate in both the horizontal and vertical directions.

9. A detonator net weapon as defined in claim 1 wherein said polygonal body of the net is rectangular in shape.

10. A detonator net weapon as defined in claim 1 wherein said polygonal body of the net is circular in shape.

* * * * *